United States Patent [19]

Takeuchi et al.

[11] Patent Number: 4,482,403

[45] Date of Patent: Nov. 13, 1984

[54] WATER-IN-OIL EMULSION EXPLOSIVE COMPOSITION

[75] Inventors: Fumio Takeuchi; Masao Takahashi; Hiroshi Sakai, all of Chita, Japan

[73] Assignee: Nippon Oil and Fats Company, Limited, Japan

[21] Appl. No.: 591,671

[22] Filed: Mar. 20, 1984

[30] Foreign Application Priority Data

May 10, 1983 [JP] Japan ..... 58-80005

[51] Int. Cl.[3] ..... C06B 45/00

[52] U.S. Cl. ..... 149/2; 149/21; 149/46; 149/61; 149/92; 149/83

[58] Field of Search ..... 149/2, 21, 46, 61, 92, 149/83

[56] References Cited

U.S. PATENT DOCUMENTS

| | | | |
|---|---|---|---|
| 4,110,134 | 8/1978 | Wade | 149/2 |
| 4,287,010 | 9/1981 | Owen | 149/2 |
| 4,383,873 | 5/1983 | Wade et al. | 149/2 |

*Primary Examiner*—Stephen J. Lechert, Jr.
*Attorney, Agent, or Firm*—Parkhurst & Oliff

[57] ABSTRACT

A water-in-oil emulsion explosive composition containing an emulsifier consisting of a mixture of sorbide, sorbitan and sorbitol fatty acid esters in a specifically limited mixing ratio, has an improved storage stability in initiation sensitivity in small diameter cartridges and at low temperatures and further has an improved resistance against dead pressing.

2 Claims, No Drawings

WATER-IN-OIL EMULSION EXPLOSIVE COMPOSITION

BACKGROUND OF THE INVENTION (1) Field of the Invention

The present invention relates to a water-in-oil emulsion explosive composition (hereinafter, abbreviated as W/O emulsion explosive composition), and more particularly relates to a W/O emulsion explosive composition containing a specifically limited emulsifier, which forms W/O emulsion, and having an improved storage stability in initiation sensitivity in a small diameter cartridge (25 mm) and at low temperatures and further having an improved resistance against dead pressing.

(2) Description of the Prior Art

W/O emulsion explosive compositions have hitherto been investigated. Recently, there have been proposed several W/O emulsion explosive compositions having an improved initiation sensitivity in small diameter cartridges (capable of being detonated by a blasting cap) without containing any explosive sensitizers, such as nitroglycerine and the like; non-explosive sensitizers, such as monomethylamine nitrate and the like; and auxiliary sensitizers, such as detonation catalyst, sensitive oxidizer and the like.

For example, U.S. Pat. No. 4,110,134 discloses that a W/O emulsion explosive composition, which contains sorbitan monooleate sold under the trademark of Glycomul "O" as an emulsifier and further contains glass microballoons as a gas-retaining agent, is completely detonated (explosive temperature: 21.1°–26.7° C.) up to a density of maximum 1.25 in a cartridge diameter of about 1.25 inches (31.8 mm) by a No. 6 blasting cap after 18–24 hours from the production of the explosive composition. (The inventors have found out by a gaschromatography that Glycomul "O" is actually, as described later, a mixture of sorbide oleate, sorbitan oleate and sorbitol oleate in a mixing ratio of sorbide oleate/sorbitan oleate/sorbitol oleate of about 25/68/7 in weight basis, each of the esters being a mixture of mono-, di- and tri-esters.)

Japanese patent laid-open specification No. 188,482/82 discloses that a W/O emulsion explosive composition, which contains, as an emulsifier, monolaurate, monoisostearate, monolinoleate, dioleate, trioleate or tetraoleate of sorbitol (each of these fatty acid esters of sorbitol is not used in the form of a mixture of mono-, di- and tri-esters, but is used in the form of a single compound) can be completely detonated at −5° C. by a No. 6 blasting cap even after 21–33 temperature cycles, in each of which cycles the explosive composition is kept at 60° C. for 24 hours and then at −15° C. for 24 hours, and which 21–33 cycles correspond to about 21–33 months of storage at room temperature (10°–30° C.).

However, when the W/O emulsion explosive compositions containing the emulsifiers of the above described U.S. patent and Japanese patent laid-open specification were subjected to a temperature cycle test, which was carried out by the inventors of the present invention and can indicate relatively correctly the actural storage life of the explosive compositions at room temperature (0°–30° C.), and wherein such a temperature cycle that a sample explosive composition is kept at 60° C. for 24 hours and then at −15° C. for 24 hours, is repeated until the sample explosive composition is no longer detonated at −5° C. by a No. 6 blasting cap (one cycle corresponds to about one month storage at room temperature), the W/O emulsion explosive composition of the U.S. patent and that of the Japanese patent laid-open specification were completely detonated after 19 and 29 cycles (corresponding to 19 and 29 months), respectively. That is, both the W/O emulsion explosive compositions are satisfactory in storage stability for the use in Japan. However, W/O emulsion explosive is inherently thermodynamically unstable, and is broken due to the lapse of time and other various reasons. As the result, W/O emulsion explosive is decreased in its initiation sensitivity and is not finally detonated by a blasting cap. Among others, the most serious phenomenon is the non-explosion phenomenon (generally called as "dead pressing phenomenon"), which is caused by the breakage of emulsion due to the actions of preceding shock wave from pre-explosion in a same bore hole, shock wave from pre-explosion in an adjacent bore hole, combustion gas and the like. When the stability of W/O emulsion and the above described non-explosion phenomenon (dead pressing phenomenon) are taken into consideration, the above described storage lives of 19 and 29 months are still unsatisfactory, and the development of a W/O emulsion explosive composition having a high storage stability in initiation sensitivity in a small diameter cartridge (25 mm diameter) and at low temperatures and having a high resistance of W/O emulsion against dead pressing has been eagerly demanded.

The inventors have made various investigations for a long period of time by taking the above described problems into consideration, and have found out that a W/O emulsion explosive composition containing, as an emulsifier, a mixture of sorbide fatty acid ester, sorbitan fatty acid ester and sorbitol fatty acid ester in a specifically limited mixing ratio, which has never hitherto been known, of the esters has a very superior performance in the storage stability in initiation sensitivity in small diameter cartridges and at low temperatures and further in the resistance against dead pressing to the performance of W/O emulsion explosive compositions containing a conventional emulsifier. As the result, the present invention has been accomplished.

SUMMARY OF THE INVENTION

The feature of the present invention lies in a W/O emulsion explosive composition, comprising a disperse phase formed of an aqueous oxidizer solution consisting mainly of ammonium nitrate; a continuous phase formed of a combustible material consisting of oil; an emulsifier; and micro-voids, the improvement comprising said emulsifier consisting of a mixture of sorbide fatty acid ester, sorbitan fatty acid ester and sorbitol fatty acid ester in a mixing ratio of sorbide fatty acid ester/sorbitan fatty acid ester/sorbitol fatty acid ester of (5–30)/(5–75)/(15–90) in weight basis.

DESCRIPTION OF THE PREFERRED EMBODIMENT

The aqueous oxidizer solution to be used in the W/O emulsion explosive composition of the present invention consists mainly of ammonium nitrate and occasionally contains other inorganic oxidizer salts. The other inorganic oxidizer salts are, for example, nitrates of alkali metal or alkaline earth metal, such as sodium nitrate, calcium nitrate and the like. Further, auxiliary sensitive substances, such as perchlorate, chlorate and the like of alkali metal or alkaline earth metal, or sensitive substances, such as monomethylamine nitrate and the like, are not essential components for improving the storage stability in initiation sensitivity and the resistance against dead pressing of the resulting W/O emulsion explosive composition, but may be contained in the explosive composition. Ammonium nitrate is used alone or in admixture with at least one of the other inorganic oxidizer salts. Ammonium nitrate is generally used in an amount of 46–95% (in weight basis; hereinafter, % means % by weight) based on the total amount of the resulting W/O emulsion explosive composition. The other inorganic oxidizer salts can occasionally be contained in the W/O emulsion explosive composition in an amount of not more than 40% based on the total amount of the inorganic oxidizer salts inclusive of ammonium nitrate.

When the compounding amount of ammonium nitrate is less than the lower limit of 46%, the resulting W/O emulsion explosive composition is significantly poor in the oxygen balance (relation in the amount of oxygen between oxidizer and combustible material), that is, the explosive composition is extremely deficient in the amount of oxygen, and is poor in the detonability and after-detonation fume. When the amount of ammonium nitrate is more than the upper limit of 95%, the lowest dissolving temperature of the ammonium nitrate in water is too high, and the productivity of the aimed W/O emulsion explosive composition is poor, and further the explosion reactivity of ammonium nitrate is low and the initiation sensitivity of the resulting W/O emulsion explosive composition is low.

When a small amount of the above described other inorganic oxidizer salt is added to the raw material mixture, an increased amount of oxygen can be supplied, and further the lowest dissolving temperature of inorganic oxidizer salts inclusive of ammonium nitrate can be lowered, and hence a W/O emulsion explosive composition having a higher detonability can be produced in a higher productivity. However, when the amount of the other inorganic oxidizer salt is more than 40% based on the total amount of inorganic oxidizer salts inclusive of ammonium nitrate, a large amount of solid residue remains after explosion of the resulting W/O emulsion explosive composition, and hence the explosive composition is poor in the strength, or is not advantageous for the commercial use.

The amount of water used in the formation of the aqueous oxidizer solution is generally 5–25% based on the total amount of the resulting W/O emulsion explosive composition.

When the amount of water is less than 5%, the lowest temperature required for dissolving ammonium nitrate or a mixture of ammonium nitrate and the other inorganic oxidizer salt is high, and hence the productivity of the aimed W/O emulsion explosive composition is low, and further the initiation sensitivity of the resulting explosive composition is poor due to the lowering of explosion reactivity of ammonium nitrate or a mixture of ammonium nitrate and the other inorganic oxidizer salt.

When the amount of water is more than 25%, the lowest temperature required for dissolving ammonium nitrate or a mixture of ammonium nitrate and the other inorganic oxidizer salt is low, and hence the productivity of the aimed W/O emulsion explosive composition is high, but the resulting explosive composition is poor in the initiation sensitivity and in the strength due to the decrease of the amount of gas, the heat and the like generated by the explosion.

The oil includes fuel oil and/or wax. The fuel oil includes hydrocarbons, such as paraffinic hydrocarbon, olefinic hydrocarbon, naphthenic hydrocarbon, aromatic hydrocarbon, other saturated or unsaturated hydrocarbon, petroleum, purified mineral oil, lubricant, liquid paraffin and the like; and hydrocarbon derivatives, such as nitrohydrocarbon and the like. The wax includes microcrystalline wax, petrolatum, paraffin wax and the like, which are derived from petroleum; mineral waxes, such as montan wax, ozokerite and the like; animal waxes, such as whale wax and the like; and insect waxes, such as beeswax and the like. These fuel oil and/or wax are generally used alone or in admixture. The compounding amount of the oil is generally 0.1–10% based on the total amount of the resulting W/O emulsion explosive composition.

When the amount of oil is less than 0.1%, the resulting W/O emulsion explosive composition is poor in the stability. When the amount of oil is more than 10%, the oxygen balance is too poor, and hence the detonability and after-detonation fume of the resulting explosive composition are poor.

The mixture of sorbide fatty acid ester, sorbitan fatty acid ester and sorbitol fatty acid ester, which can be used as an emulsifier for the W/O emulsion explosive composition of the present invention, is a mixture of esters of sorbide, sorbitan and sorbitol with a carboxylic acid represented by the following general formula

RCOOH wherein R represents $C_nH_{2n+1}$, $C_nH_{2n-1}$, $C_{2n}H_{2n-3}$ or $C_nH_{2n-5}$ (n is an integer of 9–24). The fatty acid includes straight chain and branched chain saturated fatty acids, such as lauric acid, myristic acid, palmitic acid, stearic acid, arachic acid, behenic acid, isostearic acid and the like; mono-en unsaturated fatty acids, such as oleic acid, elaidic acid, erucic acid, brassidic acid and the like; poly-en unsaturated fatty acids, such as linoleic acid, eleostearic acid, linolenic acid, arachidonic acid and the like; oxygen containing fatty acids, such as ricinoleic acid and the like; and natural fatty acids, such as corn oil fatty acid, olive oil fatty acid, rice bran oil fatty acid, safflower oil fatty acid, tall oil fatty acid and the like. The emulsifier to be used in the present invention is a mixture of esters of sorbide, sorbitan and sorbitol with the above described fatty acid in a mixing ratio of sorbide fatty acid ester/sorbitan fatty acid ester/sorbitol/fatty acid ester of (5–30)/(5–75)/(15–90) in weight basis.

The use of an emulsifier having a mixing ratio of the esters outside the above described range results in a W/O emulsion explosive composition having a poor storage stability in initiation sensitivity in small diameter cartridges and at low temperatures, and a poor resistance against dead pressing.

The amount of the emulsifier to be contained in the W/O emulsion explosive composition of the present invention is 0.1–7%, preferably 0.5–4%, based on the total amount of the explosive composition. When the amount of the emulsifier is less than 0.1%, the resulting W/O emulsion explosive composition is not satisfactorily improved in the storage stability in initiation sensitivity in small diameter cartridges and at low temperatures and in the resistance against dead pressing. When the amount is more than 7%, oxygen balance is lost and the detonability and afterdetonation fume of the resulting W/O emulsion explosive composition are poor, and the use of an explosive composition containing less than 0.1% or more than 7% of the emulsifier is not economically advantageous.

The emulsifier defined in the present invention can be produced in the following manner. Sorbitol is mixed with a fatty acid in a certain mixing ratio (ratio of amount of fatty acid/total amount of sorbitol: about 0.1/1.0 to about 3.0/1.0), and the resulting mixture is treated in the presence of a proper catalyst, such as sodium carbonate or the like, at a proper reaction temperature (120°-280° C.) for a proper reaction time (2-10 hours) to effect the dehydration of the sorbitol and the esterification reaction and to produce a mixture consisting of sorbide fatty acid ester, sorbitan fatty acid ester and sorbitol fatty acid ester in a desired mixing ratio of the esters.

The W/O emulsion explosive composition of the present invention is adjusted its density to 0.80-1.35, preferably 1.00-1.20, by using a density adjusting agent. The density adjusting agent is micro-voids formed in the explosive composition by hollow microspheres or microbubbles. As the hollow microspheres, use is made of inorganic hollow microspheres obtained from, for example, glass, alumina, shale, shirasu (shirasu is a kind of volcanic ash), silica sand, volcanic rock, sodium silicate, borax, perlite, obsidian and the like; carbonaceous hollow microspheres obtained from pitch, coal and the like; and synthetic resin hollow microspheres obtained from phenolic resin, polyvinylidene chloride, epoxy resin, urea resin and the like. These hollow microspheres are used alone or in admixture. The compounding amount of the hollow microspheres is generally 0.1-10% based on the total amount of the resulting explosive composition. The microbubbles include microbubbles formed by adding a chemical foaming agent to the raw material mixture, and microbubbles formed by mechanically blowing air or other gas into the raw material mixture at the step for forming a W/O emulsion or at the step after the W/O emulsion is formed. As the chemical foaming agent, use is made of inorganic chemical foaming agents, such as alkali metal borohydride, a mixture of sodium nitrite and urea, and the like; and organic chemical foaming agents, such as N,N'-dinitrosopentamethylenetetramine, azodicarbonamide, azobisisobutyronitrile and the like. These chemical foaming agents are used alone or in admixture. The compounding amount of the chemical foaming agent is generally 0.01-2% based on the total amount of the resulting explosive composition.

When hollow microspheres are used in an amount of less than 0.1% or a chemical foaming agent is used in an amount of less than 0.01%, both based on the total amount of the resulting W/O emulsion explosive composition, or when air or other gas is blown into the raw material mixure in such an amount that the resulting W/O emulsion explosive composition has a density of higher than 1.35, the resulting explosive composition is poor in the initiation sensitivity and further has a low detonation velocity even when the explosive composition is detonated.

When hollow microspheres are used in an amount of more than 10%, or a chemical foaming agent is used in an amount of more than 2%, both based on the total amount of the resulting W/O emulsion explosive composition, or when air or other gas is blown into the raw material mixture in such an amount that the resulting W/O emulsion explosive composition has a density of lower than 0.80, the resulting explosive composition is high in the initiation sensitivity, but is low in the strength due to its low detonation velocity.

The W/O emulsion explosive composition of the present invention is produced, for example, in the following manner. That is, ammonium nitrate or a mixture of ammonium nitrate and at least one other inorganic oxidizer salt is dissolved in water at a temperature of about 90°-95° C. to obtain an aqueous oxidizer solution. An emulsifier is mixed with oil at a temperature of 90°-95° C. to obtain a melted mixture of the emulsifier and the oil (hereinafter, the mixture is referred to as "combustible material mixture"). Then, the combustible material mixture is first charged into a heat-insulating vessel having a certain capacity, and then the aqueous oxidizer solution is gradually added to the combustible material mixture while agitating the resulting mixture by means of a commonly used propeller blade-type agitator. After completion of the addition, the resulting mixture is further agitated at a rate of about 1,600 rpm for about 5 minutes to obtain a W/O emulsion kept at about 90° C. Then, the W/O emulsion is mixed with hollow microspheres or a chemical foaming agent in a vertical type kneader while rotating the kneader at a rate of about 30 rpm, to obtain a W/O emulsion explosive composition of the present invention. When it is intended to contain microbubbles by blowing air or other gases in a W/O emulsion explosive composition in place of hollow microspheres or microbubbles formed from a chemical foaming agent, the above described W/O emulsion is agitated while blowing air or other gases into the W/O emulsion, to obtain the W/O emulsion explosive composition.

The following examples are given for the purpose of illustration of this invention and are not intended as limitations thereof. In the examples, "parts" and "%" mean by weight.

All the esters of sorbide, sorbitan and sorbitol with each of oleic acid, stearic acid, isostearic acid, lauric acid, linoleic acid, corn oil fatty acid and tall oil fatty acid, which are used in the following Examples and Comparative examples, were produced under the above described production condition, except the emulsifier of Comparative example 1. The esters were occasionally separated and purified. The mixing ratio of sorbide fatty acid ester/sorbitan fatty acid ester/sorbitol fatty acid ester in an emulsifier was measured by gaschromatography after the ester mixture was silylated.

The emulsifier of Comparative example 1 is sorbitan monooleate sold under the trademark of Glycomul "O" by Glyco Chemicals Co. When the Glycomul "O" was silylated and the silylated Glycomul "O" was analyzed by a gaschromatography it was found that Glycomul "O" was a mixture having a mixing ratio of sorbide oleate/sorbitan oleate/sorbitol oleate of 24.7/68.2/7.1, and further having a ratio of monoester/diester/triester of 1/1.5/0.5.

EXAMPLE 1

A W/O emulsion explosive composition having a compounding recipe shown in the following Table 1 was produced in the following manner. To 55.25 parts (11.05%) of water were added 381.5 parts (76.30%) of ammonium nitrate and 22.8 parts (4.57%) of sodium nitrate, and the resulting mixture was heated to about 90° C. to dissolve the nitrates in water and to obtain an aqueous oxidizer solution. A mixture of 8.75 parts (1.75%) of an emulsifier of the present invention, which emulsifier is a mixture of sorbide oleate, sorbitan oleate and sorbitol oleate in a mixing ratio of sorbide oleate/-sorbitan oleate/sorbitol oleate of 9.0/68.9/22.1 defined in the present invention, in the mixture the ratio of monoester/diester/triester being 1/1.5/0.5, and 17.05 parts (3.41%) of microcrystalline wax (trademark: Waxrex 602, made by Mobil Oil Corp.) was heated and melted to obtain a combustible material mixture kept at about 90° C. Into a heat-insulating vessel was charged the above described combustible material mixture, and then the above described aqueous oxidizer solution was gradually added to the combustible material mixture while agitating the resulting mixture by means of a propeller blade-type agitator. After completion of the addition, the resulting mixture was further agitated at a rate of about 1,600 rpm for 5 minutes to obtain a W/O emulsion kept at about 90° C. Then, the W/O emulsion was mixed with 14.60 parts (2.92%) of glass hollow microspheres having an average particle size of 75 μm (B15/250; made by Minnesota Mining Manufacturing Co.) in a vertical type kneader while rotating the kneader at a rate of about 30 rpm, to obtain a W/O emulsion explosive composition. The resulting W/O emulsion explosive composition was molded into a shaped article having a diameter of 25 mm and a length of about 170 mm and having a weight of 100 g, and the shaped article was packed with a viscose-processed paper to form a cartridge, which was used in the following performance tests:

(A) density measurement after one day from the production;

(B) storage stability test for initiation sensitivity, wherein such a temperature cycle that a sample cartridge was kept at 60° C. for 24 hours and then at −15° C. for 24 hours was repeated to deteriorate forcedly the sample cartridge, initiation tests of the above treated sample cartridge were effected at −5° C. by using a No. 6 blasting cap during the repeating temperature cycles until the sample cartridge was no longer detonated, and the number of the repreated temperature cycles was measured and estimated to be the number of months, within which the sample cartridge was able to be storaged at room temperature (10°-30° C.) while maintaining its complete detonability (this estimation is based on the experimental data that the above described one temperature cycle corresponds substantially to one month storage at room temperature);

(C) density measurement at the final complete detonation in the storage stability test in the above item (B); and (D) resistance test against dead pressing, wherein a sample cartridge having 100 g of the explosive composition packed in a viscose-processed paper, and 50 g of dynamite were hung apart from each other in a certain distance, the sample cartridge was initiated after one second from the complete detonation of 50 g of the dynamite, and the highest complete detonation pressure (kg/cm$^2$) in water of the sample cartridge was calculated from the minimum distance, at which the sample cartridge was completely detonated.

The obtained results are shown in Table 1.

EXAMPLES 2-9

A W/O emulsion explosive composition was produced according to Example 1 and according to the compounding recipe shown in Table 1. In each of Examples 2-9, an emulsifier consisting of a mixture of sorbide ester, sorbitan ester and sorbitol ester of a fatty acid in a mixing ratio shown in Table 1 was used in place of the emulsifier used in Example 1. A sample cartridge was produced from each of the above obtained W/O emulsion explosive compositions in the same manner as described in Example 1, and subjected to the same performance tests as described in Example 1. The obtained results are shown in Table 1.

EXAMPLE 10

A W/O emulsion explosive composition was produced according to Example 1 and according to the compounding recipe shown in Table 1, wherein N,N'-dinitrosopentamethylenetetramine was used in place of the glass hollow microspheres used in Example 1. A sample cartridge was produced from the above obtained W/O emulsion explosive composition in the same manner as decribed in Example 1. The sample cartridge was heated in a thermostat kept at about 50° C. for 2 hours to decompose and foam the compound chemical foaming agent (N,N'-dinitrosopentamethylenetetramine) and to adjust the density, and the above treated sample cartridge was subjected to the same performance tests as described in Example 1. The obtained results are shown in Table 1.

EXAMPLE 11

A W/O emulsion explosive composition having a compounding recipe shown in Table 1 was produced in the following manner. That is, a W/O emulsion was produced according to Example 1 and agitated at a rate of about 1,600 rpm for 2 minutes by means of a propeller blade-type agitator while blowing air into the emulsion through nozzles having a small diameter, to introduce microbubbles of air into the emulsion, resulting in a W/O emulsion emplosive composition having a given density. A sample cartrige was produced from the above obtained W/O emulsion explosive composition in the same manner as described in Example 1, and subjected to the same performance tests as described in Example 1. The obtained results are shown in Table 1.

TABLE 1

| Example | | 1 | 2 | 3 | 4 | 5 | 6 | 7 | 8 | 9 | 10 | 11 |
|---|---|---|---|---|---|---|---|---|---|---|---|---|
| Compounding recipe (%) | | | | | | | | | | | | |
| Aqueous oxidizer solution | Ammonium nitrate | 76.30 | 76.30 | 76.30 | 76.30 | 76.30 | 76.30 | 76.30 | 48.70 | 49.70 | 79.44 | 83.31 |
| | Sodium nitrate | 4.57 | 4.57 | 4.57 | 4.57 | 4.57 | 4.57 | 4.57 | 12.40 | 12.40 | 4.70 | — |
| | Calcium nitrate | — | — | — | — | — | — | — | 12.40 | 12.40 | — | — |
| | Water | 11.05 | 11.05 | 11.05 | 11.05 | 11.05 | 11.05 | 11.05 | 11.20 | 11.20 | 11.36 | 11.38 |
| Combustible material | Microcrystalline wax (Waxrex 602) | 3.41 | 3.41 | 3.41 | 3.41 | 3.41 | 3.41 | 3.41 | — | — | 3.50 | 3.51 |
| | Liquid paraffine | — | — | — | — | — | — | — | 4.30 | 4.30 | — | — |
| (note) | (M/D/T:1/1.5/0.5); | 1.75 | — | — | — | — | — | — | — | 0.90 | — | — |
| Emul- | SBE/STAE/STOE(9.0/68.9/22.1:oleic acid) | | | | | | | | | | | |

TABLE 1-continued

| Example | | 1 | 2 | 3 | 4 | 5 | 6 | 7 | 8 | 9 | 10 | 11 |
|---|---|---|---|---|---|---|---|---|---|---|---|---|
| sifier | SBME/STAME/STOME (11.2/53.8/35.0:isostearic acid) | — | 1.75 | — | — | — | — | — | 3.50 | 0.80 | 0.80 | 1.80 |
| | SBDE/STADE/STODE(20.4/34.7/44.9:stearic acid) | — | — | 1.75 | — | — | — | — | — | — | — | — |
| | SBDE/STADE/STODE(8.3/41.6/50.1:lauric acid) | — | — | — | 1.75 | — | — | — | — | — | — | — |
| | SBTE/STATE/STOTE(15.2/23.9/60.9:linoleic acid) | — | — | — | — | 1.75 | — | — | — | 0.80 | — | — |
| | SBME/STAME/STOME (10.7/18.5/70.8:corn oil fatty acid) | — | — | — | — | — | 1.75 | — | — | — | — | — |
| | (M/D/T:1/2/1); SBE/STAE/STOE(7.6/10.4/82.0:tall oil fatty acid) | — | — | — | — | — | — | 1.75 | — | — | — | — |
| Other ingre-dient perfor-mance | Glass hollow microspheres (B15/250) | 2.92 | 2.92 | 2.92 | 2.92 | 2.92 | 2.92 | 2.92 | — | — | — | — |
| | Silica hollow microspheres (Silica balloon NL) | — | — | — | — | — | — | — | 7.50 | 7.50 | — | — |
| | N,N'—dinitrosopentamethylenetetramine | — | — | — | — | — | — | — | — | — | 0.20 | — |
| (A) Density after one day from production | | 1.09 | 1.08 | 1.07 | 1.08 | 1.09 | 1.08 | 1.07 | 1.08 | 1.09 | 1.09 | 1.07 |
| (B) Storage stability in initiation sensitivity (The number of storage months while maintaining complete detonability) | | 35 | 38 | 36 | 37 | 37 | 39 | 39 | 42 | 40 | 32 | 31 |
| (C) Density at the final complete detonation | | 1.09 | 1.10 | 1.09 | 1.10 | 1.09 | 1.10 | 1.10 | 1.10 | 1.11 | 1.11 | 1.08 |
| (D) Resistance against dead pressing (Highest complete detonation pressure, kg/cm$^2$) | | 124 | 114 | 114 | 124 | 114 | 124 | 105 | 192 | 170 | 79 | 04482-40301-805 70 |

(Note)
SBME: sorbide fatty acid monoester
STAME: sorbitan fatty acid monoester
STOME: sorbitol fatty acid monoester
SBDE: sorbide fatty acid diester
STADE: sorbitan fatty acid diester
STODE: sorbitol fatty acid diester
SBTE: sorbide fatty acid triester
STATE: sorbitan fatty acid triester
STOTE: sorbitol fatty acid triester
SBE: sorbide fatty acid (mono-, di-, and tri-) esters
STAE: sorbitan fatty acid (mono-, di-, and tri-) esters
STOE: sorbitol fatty acid (mono-, di-, and tri-) esters
M/D/T is the ratio (in weight basis) of monoester/diester/triester.

COMPARATIVE EXAMPLES 1–10

A W/O emulsion explosive composition was produced according to Example 1 and according to the compounding recipe shown in Table 2. In Comparative examples 1–10 a conventional emulsifier or an emulsifier produced by the inventors but having a composition outside the range defined in the present invention was used. A sample cartridge was produced from the above obtained W/O emulsion explosive composition in the same manner as described in Example 1, and subjectd to the same performance tests as described in Example 1. The obtained results are shown in Table 2.

COMPARATIVE EXAMPLES 11 AND 12

A W/O emulsion explosive composition was produced according to Example 1 and according to the compounding recipe shown in Table 2. In Comparative examples 11 and 12, a conventional emulsifier or an emulsifier produced by the inventors but having a composition outside the range defined in the present invention was used. A sample cartridge was produced from the above obtained W/O emulsion explosive composition in the same manner as described in Example 1, and subjected to the same performance tests as described in Example 1. The obtained results are shown in Table 2.

TABLE 2

| Comparative example | 1 | 2 | 3 | 4 | 5 | 6 | 7 | 8 | 9 | 10 | 11 | 12 |
|---|---|---|---|---|---|---|---|---|---|---|---|---|
| Compounding recipe (%) | | | | | | | | | | | | |
| Aqueous oxidizer solution | | | | | | | | | | | | |
| Ammonium nitrate | 76.30 | 76.30 | 76.30 | 76.30 | 76.30 | 76.30 | 76.30 | 76.30 | 76.30 | 48.70 | 79.44 | 83.31 |
| Sodium nitrate | 4.57 | 4.57 | 4.57 | 4.57 | 4.57 | 4.57 | 4.57 | 4.57 | 4.57 | 12.40 | 4.70 | — |
| Calcium nitrate | — | — | — | — | — | — | — | — | — | 12.40 | — | — |
| Water | 11.05 | 11.05 | 11.05 | 11.05 | 11.05 | 11.05 | 11.05 | 11.05 | 11.05 | 11.20 | 11.36 | 11.38 |
| Combustible material | | | | | | | | | | | | |
| Microcrystalline wax (Waxrex 602) | 3.41 | 3.41 | 3.41 | 3.41 | 3.41 | 3.41 | 3.41 | 3.41 | 3.41 | — | 3.50 | 3.51 |
| Liquid paraffine | — | — | — | — | — | — | — | — | — | 4.30 | — | — |
| (note) Emulsifier | | | | | | | | | | | | |
| (M/D/T:1/1.5/0.5); SBE/STAE/STOE(24.7/68.2/7.1:oleic acid)*a | 1.75 | — | — | — | — | — | — | — | — | — | — | — |
| SBME/STAME/STOME(0/0/100:isostearic acid)*b | — | 1.75 | — | — | — | — | — | — | — | 3.50 | 0.80 | 1.80 |
| SBDE/STADE/STODE(49.6/40.1/10.3:stearic acid) | — | — | 1.75 | — | — | — | — | — | — | — | — | — |
| SBDE/STADE/STODE(35.2/14.3/50.5:lauric acid) | — | — | — | 1.75 | — | — | — | — | — | — | — | — |
| SBTE/STATE/STOTE(5.3/80.5/14.2:linoleic acid) | — | — | — | — | 1.75 | — | — | — | — | — | — | — |
| SBME/STAME/STOME (67.8/19.5/12.7:corn oil fatty acid) | — | — | — | — | — | 1.75 | — | — | — | — | — | — |
| (M/D/T:1/2/1); SBE/STAE/STOE(44.7/14.7/40.6:tall oil fatty acid) | — | — | — | — | — | — | 1.75 | — | — | — | — | — |
| SBDE/STADE/STODE(0/0/100:oleic acid)*c | — | — | — | — | — | — | — | 1.75 | — | — | — | — |
| SBTE/STATE/STOTE(0/0/100:oleic acid)*d | — | — | — | — | — | — | — | — | 1.75 | — | — | — |

TABLE 2-continued

| Comparative example | 1 | 2 | 3 | 4 | 5 | 6 | 7 | 8 | 9 | 10 | 11 | 12 |
|---|---|---|---|---|---|---|---|---|---|---|---|---|
| Other ingredient | | | | | | | | | | | | |
| Glass hollow microspheres (B15/250) | 2.92 | 2.92 | 2.92 | 2.92 | 2.92 | 2.92 | 2.92 | 2.92 | 2.92 | — | — | — |
| Silica hollow microspheres (Silica balloon NL) | — | — | — | — | — | — | — | — | — | 7.50 | — | — |
| N,N'—dinitrosopentamethylenetetramine | — | — | — | — | — | — | — | — | — | — | 0.20 | — |
| performance | | | | | | | | | | | | |
| (A) Density after one day from production | 1.08 | 1.07 | 1.07 | 1.08 | 1.07 | 1.08 | 1.07 | 1.08 | 1.07 | 1.07 | 1.08 | 1.07 |
| (B) Storage stability in initiation sensitivity (The number of storage months while maintaining complete detonability) | 19 | 25 | 19 | 18 | 15 | 18 | 21 | 29 | 26 | 28 | 13 | 9 |
| (C) Density at the final complete detonation | 1.09 | 1.08 | 1.10 | 1.09 | 1.09 | 1.08 | 1.08 | 1.08 | 1.10 | 1.08 | 1.09 | 1.11 |
| (D) Resistance against dead pressing (Highest complete detonation pressure, kg/cm$^2$) | 67 | 79 | 63 | 67 | 63 | 63 | 57 | 70 | 75 | 97 | 57 | 40 |

(Note)
*a: sorbitan monooleate [Glycomul "O" (Glyco Chemicals Co.)]
*b: sorbitol monoisostearate (produced by the inventors)
*c: sorbitol dioeleate (produced by the inventors)
*d: sorbitol trioleate (produced by the inventors)

The resulting of the Examples will be explained by comparing the results of the Comparative examples.

W/O emulsion explosive compositions of Examples 1–7, which contain an emulsifier consisting of a mixture of sorbide fatty acid ester, sorbitan fatty acid ester and sorbitol fatty acid ester in a mixing ratio of sorbide fatty acid ester/sorbitan fatty acid ester/sorbitol fatty acid ester of (5–30)/(5–75)/(15–90) defined in the present invention, have a storage life of 35–95 months within which the explosive compositions can be completely detonated at −5° C. by a No. 6 blasting cap, and have the highest complete detonation pressure of 105–124 kg/cm$^2$.

W/O emulsion explosive compositions of Comparative examples 1 and 2, which contain sorbitan monooleate (trademark: Glycomul "O", sold by Glyco Chemicals Co.) and sorbitol monoisostearate respectively as an emulsifier having a mixing ratio of sorbide, sorbitan and sorbitol fatty acid esters outside the range defined in the present invention, have a storage life of 19 and 25 months respectively, within which the explosive compositions can be completely detonated at −5° C. by a No. 6 blasting cap, and have the highest complete detonation pressure of 67 and 79 kg/cm$^2$, respectively. W/O emulsion explosive compositions of Comparative examples 3–9, which contain an emulsifier having a mixing ratio of sorbide, sorbitan and sorbitol fatty acid esters outside the range defined in the present invention, have a storage life of 15–29 months, within which the explosive compositions can be completely detonated at −5° C. by a No. 6 blasting cap, and have the highest complete detonation pressure of 57–75 kg/cm$^2$.

Further, W/O emulsion explosive compositions of Examples 8–11 containing an emulsifier having a mixing ratio of sorbide, sorbitan and sorbitol fatty acid esters defined in the present invention; that is, W/O emulsion explosive compositions, which comprise inorganic oxidizer salts consisting of a mixture of ammonium nitrate, and sodium nitrate and calcium nitrate used as other inorganic oxidizer salts, liquid paraffin as a combustible material, silica hollow microspheres as a gas-retaining agent, and an emulsifier defined in the present invention; a W/O emulsion explosive composition, which comprises inorganic oxidizer salts consisting of a mixture of ammonium nitrate and sodium nitrate as other inorganic oxidizer salts, microcrystalline wax as a combustible material, N,N'-dinitrosopentamethylenetetramine as a chemical foaming agent used in place of the above used gas-retaining agent, and an emulsifier defined in the present invention; and a W/O emulsion explosive composition, which comprises ammonium nitrate alone as an inorganic oxidizer salt, microcrystalline wax as a combustible material, microbubbles mechanically introduced into the explosive composition to adjust its density in place of the use of a gas-retaining agent, and an emulsifier defined in the present invention; have a storage life of 31–42 months, within which the explosive compositions can be completely detonated at −5° C. by a No. 6 blasting cap, and have the highest complete detonation pressure of 70–192 kg/cm$^2$. However, W/O emulsion explosive compositions of Comparative examples 10, 11 and 12, which have the same compounding recipes as those of the explosive compositions of Examples 8, 10 and 11, respectively, except that an emulsifier having a mixing ratio of sorbide, sorbitan and sorbitol fatty acid esters outside the range defined in the present invention was used in place of the emulsifier having a mixing ratio of sorbide, sorbitan and sorbitol fatty acid esters defined in the present invention, have a storage life of 9–28 months, within which the explosive compositions can be completely detonated at −5° C. by a No. 6 blasting cap, and have the highest complete detonation pressure of 40–97 kg/cm$^2$.

As described above referring to the Examples and Comparative examples, the W/O emulsion explosive composition containing an emulsifier consisting of sorbide fatty acid ester, sorbitan fatty acid ester and sorbitol fatty acid ester in a mixing ratio of sorbide fatty acid ester/sorbitan fatty acid ester/sorbitol fatty acid ester of (5–30)/(5–75)/(15–90) defined in the present invention is remarkably superior in the storage stability in initiation sensitivity in a small diameter cartridge (25 mm) and at low temperatures, and in the resistance against dead pressing to the W/O emulsion explosive composition containing, as an emulsifier, conventional sorbitan fatty acid ester or sorbitol fatty acid ester having a mixing ratio of sorbide, sorbitan and sorbitol fatty acid esters outside the range defined in the present invention.

What is claimed is:

1. In a water-in-oil emulsion explosive composition comprising a disperse phase formed of an aqueous oxidizer solution consisting mainly of ammonium nitrate; a continuous phase formed of a combustible material consisting of oil; an emulsifier; and micro-voids, the improvement comprising said emulsifier consisting of a mixture of sorbide fatty acid ester, sorbitan fatty acid ester and sorbitol fatty acid ester in a mixing ratio of sorbide fatty acid ester/sorbitan fatty acid ester/sorbitol fatty acid ester of (5–30)/(5–75)/(15–90) in weight basis.

2. A water-in-oil emulsion explosive composition according to claim 1, wherein the amount of the emulsifier is 0.1–7% by weight based on the total amount of the explosive composition.

* * * * *